US008486517B2

(12) United States Patent
Crawford, Jr.

(10) Patent No.: US 8,486,517 B2
(45) Date of Patent: Jul. 16, 2013

(54) HELICAL TEXTILE WITH UNIFORM THICKNESS

(75) Inventor: James A. Crawford, Jr., Rye, NH (US)

(73) Assignee: Crawford Textile Fabrications, LLC, Portsmouth, NH (US)

( * ) Notice: Subject to any disclaimer, the term of this patent is extended or adjusted under 35 U.S.C. 154(b) by 925 days.

(21) Appl. No.: 12/050,789

(22) Filed: Mar. 18, 2008

(65) Prior Publication Data

US 2009/0239054 A1 Sep. 24, 2009

(51) Int. Cl.
*D03D 13/00* (2006.01)

(52) U.S. Cl.
USPC ..... 428/222; 442/366; 442/368; 442/381

(58) Field of Classification Search
USPC ..... 442/366, 368, 381; 428/222
See application file for complete search history.

(56) References Cited

U.S. PATENT DOCUMENTS

| | | | | |
|---|---|---|---|---|
| 2,412,843 | A | 12/1946 | Sparagen | |
| 3,293,720 | A | 12/1966 | Cumbers | |
| 3,881,522 | A | 5/1975 | Lewis et al. | |
| 3,950,583 | A | 4/1976 | Patin | |
| 4,341,830 | A * | 7/1982 | Betts et al. | 428/66.2 |
| 4,510,657 | A | 4/1985 | Curinier et al. | |
| 4,686,134 | A | 8/1987 | Ono | |
| 4,748,996 | A * | 6/1988 | Combier | 139/415 |
| 4,907,323 | A | 3/1990 | Smith et al. | |
| 5,082,701 | A | 1/1992 | Craven et al. | |
| 5,222,866 | A | 6/1993 | LaBrouche et al. | |
| 5,242,745 | A * | 9/1993 | Aucagne et al. | 442/205 |
| 5,326,410 | A | 7/1994 | Boyles | |
| 5,484,642 | A | 1/1996 | Bompard et al. | |
| 5,603,357 | A | 2/1997 | Schomaker et al. | |
| 5,778,736 | A * | 7/1998 | Maass et al. | 74/572.12 |
| 5,795,835 | A | 8/1998 | Bruner et al. | |
| 5,952,075 | A * | 9/1999 | Clarke et al. | 428/66.2 |
| 6,009,605 | A | 1/2000 | Olry et al. | |
| 6,086,968 | A | 7/2000 | Horovitz | |
| 6,248,417 | B1 | 6/2001 | Ponsolle et al. | |
| 6,447,886 | B1 | 9/2002 | Mohamed et al. | |
| 6,491,779 | B1 | 12/2002 | Bryant | |
| 6,494,235 | B1 | 12/2002 | Bruyere et al. | |
| 6,673,442 | B2 | 1/2004 | Johnson et al. | |
| 6,684,404 | B2 | 2/2004 | Bachner, Jr. et al. | |
| 6,722,228 | B1 * | 4/2004 | Wilkinson et al. | 74/572.12 |
| 6,899,941 | B2 | 5/2005 | Goering et al. | |

(Continued)

FOREIGN PATENT DOCUMENTS

| | | | |
|---|---|---|---|
| EP | 0245065 | A2 | 11/1987 |
| EP | 1268406 | B1 | 2/2004 |

(Continued)

OTHER PUBLICATIONS

Definition "interleave" Merriam-Webster Online, http://www.merriam-webster.com/dictionary/interleave, copyright 2011 (no month), Merriam-Webster, Incorporated.*

*Primary Examiner* — Andrew Piziali
(74) *Attorney, Agent, or Firm* — Mesmer & Deleault, PLLC

(57) ABSTRACT

A helical textile having a substantially uniform thickness from ID to OD having circumferential warp fibers; non-interlaced radially aligned weft fibers having fiber lengths that may vary with the textile diameter to maintain constant textile thickness, the warp fibers and weft fibers not interlaced together; and non-reinforcing binding yarns securing the warp fibers to the weft fibers, thereby forming a helical textile.

7 Claims, 5 Drawing Sheets

U.S. PATENT DOCUMENTS

| | | | |
|---|---|---|---|
| 2002/0050446 | A1 | 5/2002 | Antoniazzi |
| 2003/0119391 | A1 | 6/2003 | Swallow et al. |
| 2005/0235471 | A1 | 10/2005 | Delecroix |

FOREIGN PATENT DOCUMENTS

| | | | |
|---|---|---|---|
| GB | 798309 | | 7/1958 |
| WO | 9709476 | A2 | 3/1997 |
| WO | 9806570 | A1 | 2/1998 |
| WO | 0050676 | A1 | 8/2000 |
| WO | 0073177 | A1 | 12/2000 |
| WO | 0175778 | A1 | 10/2001 |

* cited by examiner

HELICAL TEXTILE WITH UNIFORM THICKNESS

BACKGROUND

1. Field of the Invention

The invention relates to helical textiles.

2. Description of the Related Art

One of the primary purposes of helical or spiral shaped material is to reinforce a composite material. Therefore, the fiber selection, fiber orientation and other features of the textile material must be considered to maximize the effectiveness of the textile material as a reinforcement to the final product.

Others have described woven helical fabrics, such as that disclosed in U.S. Pat. No. 5,222,866 that was issued to LaBrouche et al. on Jun. 29, 1993, and which is not admitted to being prior art by its mention in this Background section (the '866 patent). In the '866 patent the yarns in the warp (circumferential direction of the spiral) and yarns in the weft (radial direction of the spiral) are interlaced in the manner used with traditional weaving processes and typical weave designs, such as plain weave, satin weave, and basket weave.

One example is shown in FIG. 1. The interlacings produced in the weaving process are necessary to hold the fabric together, and result in a lack of straightness in the yarns in either or both of the warp or weft directions called crimp. Crimp is introduced at fiber interlacings as illustrated in 106*a* through 106*e* between warp yarns 102 and weft yarns 104. The crimp reduces the efficiency of the fibers to translate their properties to the ultimate composite structure or textile material.

Knitting processes can be divided into two categories: warp knitting and weft knitting. Weft knitting results in a textile structure where the yarns are interlocked to adjacent yarns resulting in very tortuous fiber paths. This does not allow for effective reinforcement for high performance composites.

What is needed, therefore, is a helical textile for reinforcing composite materials that does not crimp the fibers, but has uniform thickness, and process for making the same.

SUMMARY

The invention is a helical textile that does not have interlaced warp and weft fibers yet has uniform thickness for reinforcing composite materials. The invention is a warp knit helical textile having a repeating pattern of weft fibers of varying lengths such that the overall textile has a uniform thickness. The warp layers and weft layers are secured with non-reinforcing knitted stitches. The process of making the same includes a warp knitting machine modified to have conical take-up rolls and a means for inserting the repeating pattern of weft fibers of varying lengths. These and other features, advantages, and benefits of the present invention will become more apparent with reference to the appended drawings, description, and claims.

DRAWINGS

DESCRIPTION

The invention is a warp knit helical textile having a repeating pattern of weft fibers of varying lengths such that the overall textile has a substantially uniform thickness and more consistent warp to weft fiber distribution from ID to OD. Warp knitting uses manufacturing methods to orient the fibers in layers that are not interlaced. Rather, warp and weft fibers are constructed in discrete layers, one above the other.

Figure 1:
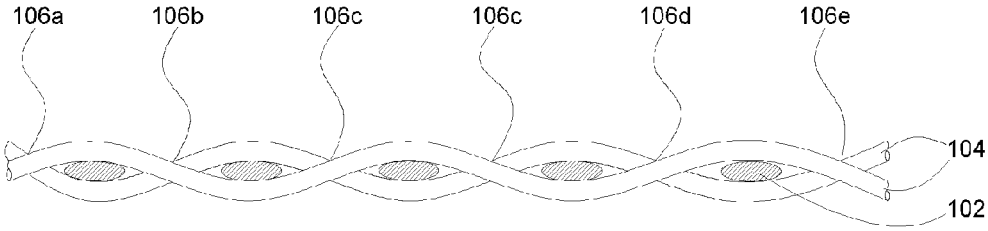
PRIOR ART Fig. 1
FIG. 1 is a side elevation of a textile of the prior art.
Figure 2:
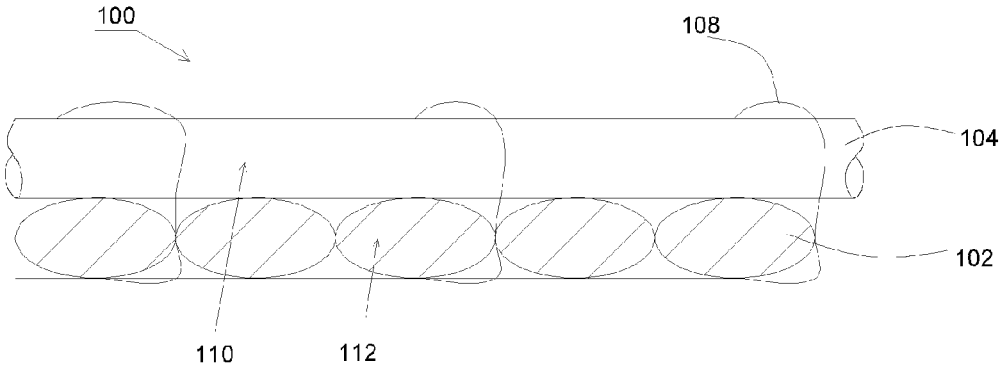
FIG. 2 is a side elevation of a textile according to the present invention.

The warp and weft fibers, in their respective layers, are straight, not crimped, and are parallel to adjacent fibers in the same layer. Turning to FIG. 2, warp fibers 102 and those next to it are shown in cross section, and are interpreted as coming out of the page. The warp fibers 102 are in the circumferential direction, and are circumferentially parallel to each other. The weft fibers 104 are in the radial direction, and are radially parallel to each other. Unlike the prior art, no interlacing between warp fiber layer and weft fiber layers are needed. The warp fibers 102 and weft fibers 104 are secured to each other or bound together with a third fiber direction. This third direction is inserted with knitted stitches 108. This third direction is not generally considered as a third reinforcing direction and is usually a non-reinforcing yarn type and in very low concentration compared to the warp and weft. The purpose of the knitted yarn is to hold the warp and weft layers together and to avoid the need to interlace the warp and weft. This third direction of yarn does not equate the resulting textile product to a three dimensional textile material since the resulting material described here is a single layer of knitted textile material. Contrast this to three dimensional weaving techniques that are used to manufacture multilayered textile materials.

The process of manufacturing the helical textile material utilizes modified warp knitting machinery. The modifications that are introduced are necessary to accommodate two issues: the take-up means to introduce the helical shape, and the weave design to accommodate the varying geometry of the textile structure from the inside diameter ("ID") to the outside diameter ("OD") of the helical material produced. In the present invention it is desired that the resulting material have an as constant as practical ratio of warp to weft fibers from ID to OD. This requires that the weft end count at the OD be higher than at the ID.

Figure 3:
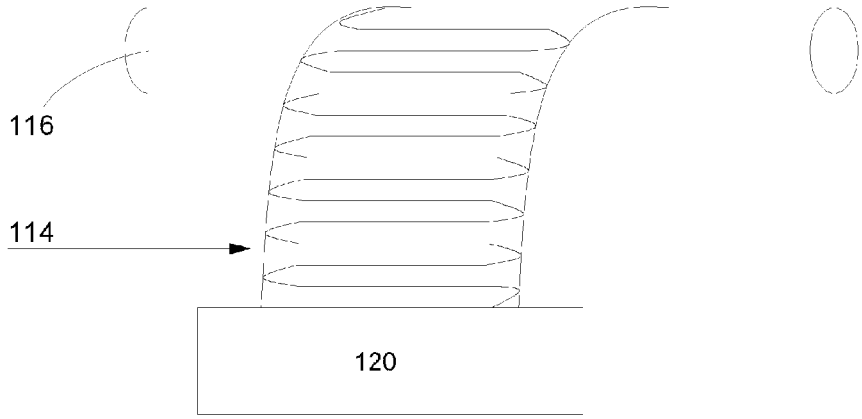
PRIOR ART Fig. 3
FIG. 3 is an orthogonal view of a take-up roll and textile of the prior art.

A warp knitting machine 120 of the prior art is shown in FIG. 3. The knitting machine 120 has a cylindrical take-up roll 116 and produces a straight woven textile 114. The warp knitting machine other than the take-up roll is shown as a black box in this drawing.

Figure 4:
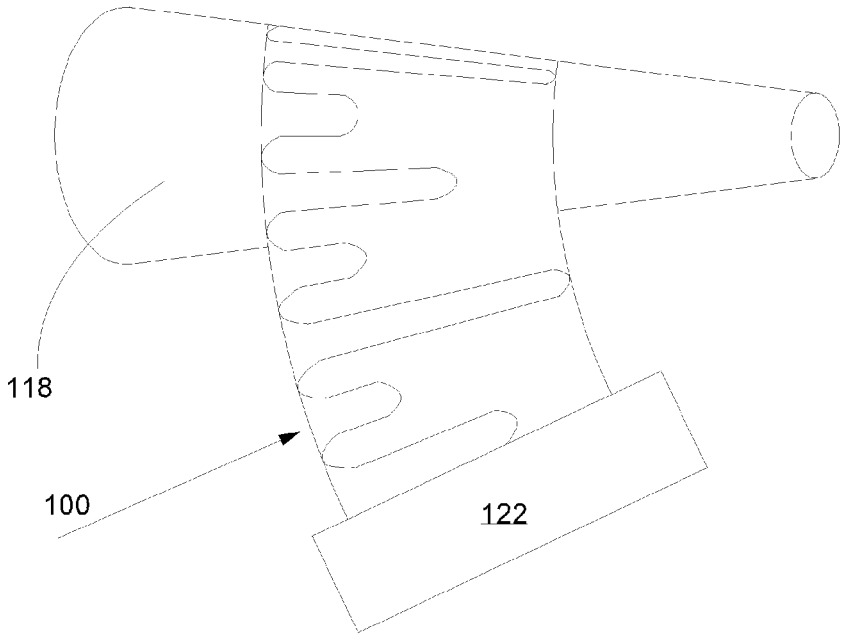
FIG. 4 is an orthogonal view of a take-up roll and textile of the present invention.

To make the helical textile 100 of the present invention, a warp knitting machine 122 is modified so that the cylindrical take-up rolls are replaced by conical take-up rolls 118 as shown in FIG. 4. The warp knitting machine is also shown as a black box in this drawing. The angle of the conical roll or rolls is designed to produce the desired ID and OD ratio of the resulting helical textile material 100. In this manner, the usual machine features necessary to adjust the take-up speed and such are maintained. A similar result is possible with a take-up mechanism that is a separate device from the knitting machine such that the material being knitted avoids the normal cylindrical take-up rolls. This separate device is controlled with mechanisms or electronic controls or both activated by features such as cams on the knitting machine.

Figure 5:
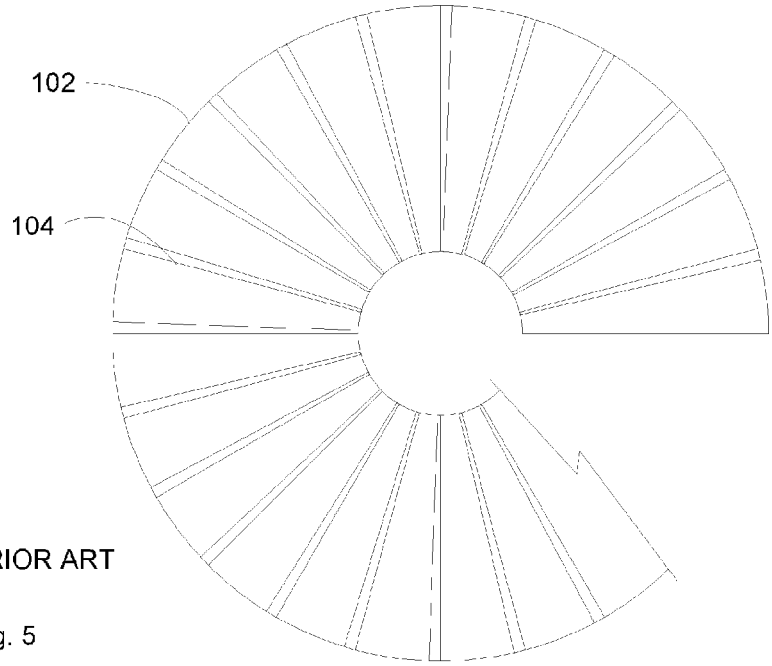
PRIOR ART Fig. 5
FIG. 5 is a plan view of a helical textile having a uniform length of weft fibers.

The ratio of warp to weft fibers will depend on the particular final application of the composite structure. Most applications envisioned will require an as uniform as practical ratio of warp to weft from ID to OD regardless of what that ratio is. This requires that not all weft (radial) fibers continue from OD to ID. For example, if we assume that the full width weft fiber length for a particular design was intended to be three inches, in a straight weave, all weft fibers would be three inches long. If in the same example but with a helical textile as shown in FIG. 5, and the weft fibers 104 are all three inches long, the spacing between adjacent weft fibers would be greater at the OD than at the ID. Therefore the weft fiber density near the ID would be greater than the OD and the thickness of the fabric near the ID would be greater than the OD. This would lead to non-uniform properties, which are undesirable.

Figure 6:
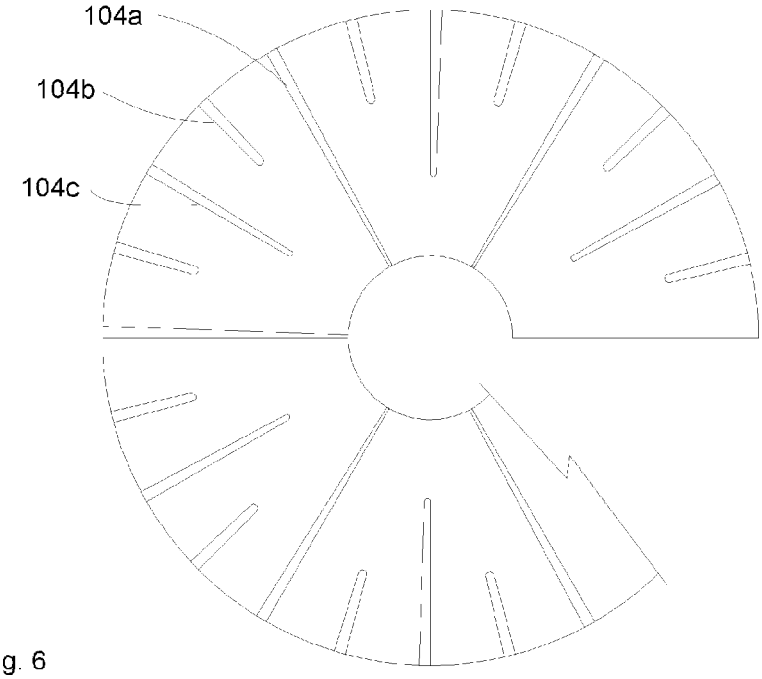
FIG. 6 is a plan view of a helical textile according to the present invention having uniform thickness.

This can be improved by introducing weft fibers 104 of less than three inch length, as shown in FIG. 6. The intent is to make the final textile material as uniform as practical from OD to ID. The weft fibers will have one end at the OD of the textile, and the other end will proceed to some predetermined location part way from the OD to ID and then terminate or return towards the OD. If individual weft fibers were inserted, then they would terminate. If a continuous weft fiber were inserted, then it would bend and return towards the OD.

In a helical textile, the repeating sequence of weft fiber insertions might be three inches 104*a*, one inch 104*b*, two inches 104*c*, one inch 104*b*, and finally three inches again 104*a*. This would allow more constant ratio of warp to weft from OD to ID. This also translates to a more constant thickness of the knitted material 100 across the width from ID to OD. It is understood that this is only an example of the different lengths of weft that can be used. A more uniform fabric can be made by increasing the number of different weft lengths, until it is no longer cost effective. The embodiment shown in FIG. 6 uses one weft insertion device.

Figure 7:
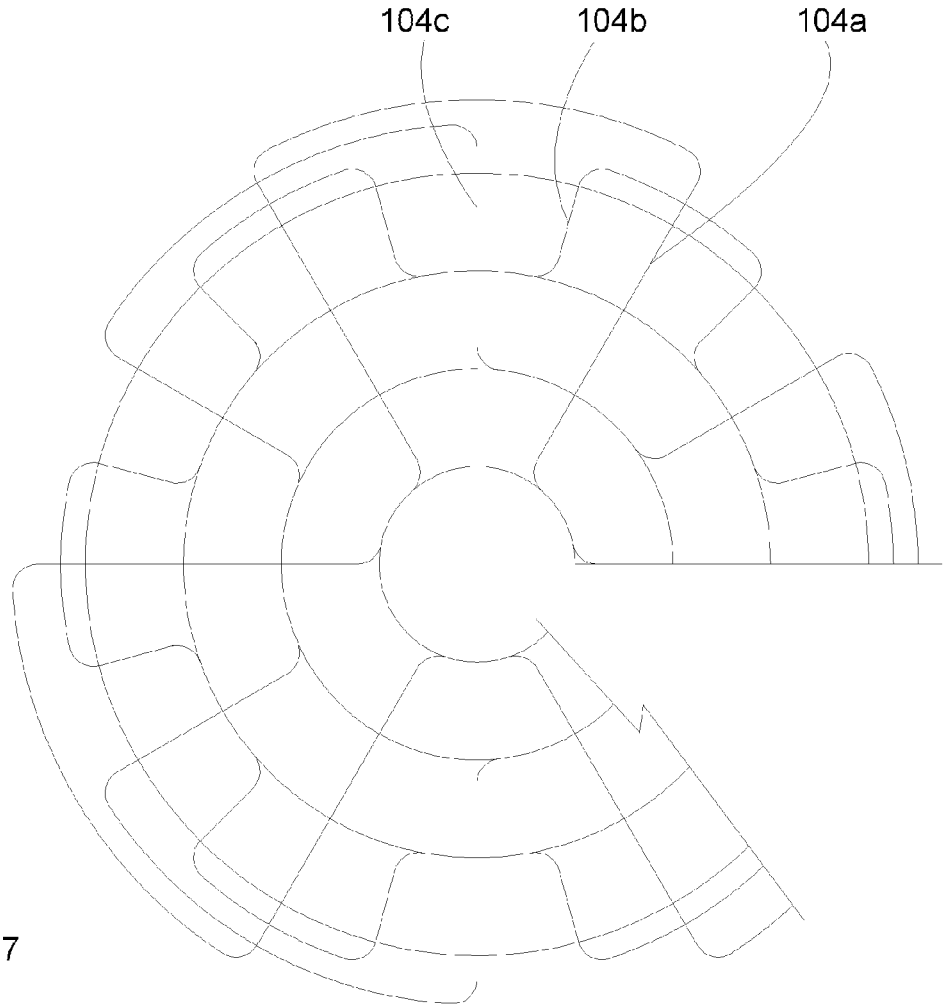
FIG. 7 is a plan view of another embodiment of a helical textile according to the present invention having uniform thickness.

More complex patterns having a single weft yarn of different lengths instead of pairs is shown in FIG. 7. In this embodiment, three weft insertion devices are required.

The length of the weft insertion, also referred to as the shot or throw direction in knitting, can be controlled with cams, pins, knuckles, or electronically, depending on the style and age of the knitting machine used. The level of control generally available in all machines of this type is such that each weft insertion (shot or throw) can be tailored to be of different length. The combination, therefore, of variable length weft insertion and conical take-up will produce the material intended.

Figure 8:
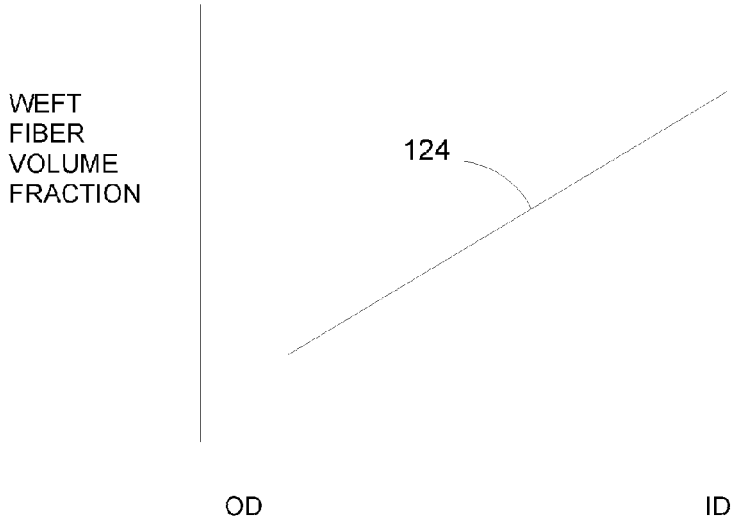
PRIOR ART Fig. 8
FIG. 8 is a graph showing weft volume fraction of a textile of the prior art.
Figure 9:
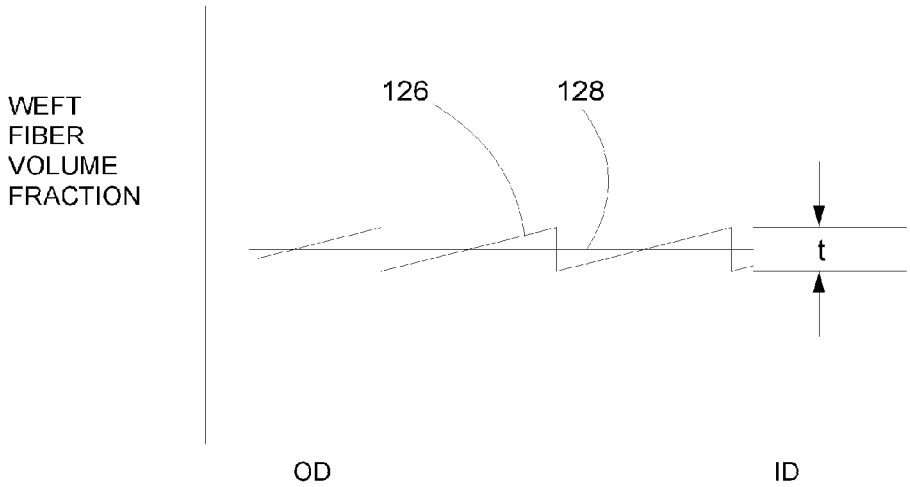
FIG. 9 is a graph showing weft volume fraction of a helical textile according to the present invention having uniform thickness.

The helical fabric of the present invention has been said to have a "more constant" thickness than that of the prior art. The thickness of a single layer of fabric is not perfectly uniform or constant, but varies by the width of a weft fibers and insertion length. FIG. 8 is a graph that shows that the weft volume fraction 124 in the prior art increases from OD to ID. This increases the thickness. FIG. 9 shows that the weft volume fraction is more constant from the OD to the ID, and the thickness will be substantially more uniform.

FIG. 9 has a curve that represents weft fiber volume fraction from OD to ID 126. The curve 126 has three peaks that correspond to the use of weft fibers of three different lengths. The difference between the peaks and troughs is the thickness "t". The thickness "t" is not exactly the same as the thickness of a weft fiber, but it is related. The thickness "t" is also related to how closely the weft fibers are inserted together. The average thickness 128 is a flat line instead of a rising line like that in FIG. 8. As defined in the specification and claims, therefore, the term "substantially" uniform shall be construed to mean uniform to within the thickness "t".

Typical applications of a textile according to the present invention would use multiple layers, i.e. a coil, of helical textile. Another application might cut 360 degree pieces and then stack them to achieve multiple layers, alternating the position of the cut and splice. Other applications would use a continuous length of helical textile without cuts and splices.

The textile can be used to reinforce composite structures, or it could be used as a textile for non-composite applications, such as for a circular gasket. The fiber types that can be used include, without limitation, carbon, graphite, glass, and ceramic.

Although the present invention has been described with reference to particular embodiments, it will be apparent to those skilled in the art that variations and modifications can be substituted therefor without departing from the principles and spirit of the invention.

I claim:

1. A helical textile having a substantially uniform thickness comprising:

circumferential warp fibers defining a radial textile width from a textile inner diameter to a textile outer diameter;

non-interlaced radially aligned weft fibers of varying lengths to maintain constant textile thickness, the warp fibers and weft fibers not crimped together; and non-reinforcing binding yarns securing the warp fibers to the weft fibers with chain stitches knitted across the radial textile width, thereby forming a helical textile.

2. The textile of claim 1, wherein the warp fibers form layers and are circumferentially parallel to each other within the same layer, and the weft fibers form layers and are radially parallel to each other within the same layer.

3. The textile of claim 2, wherein alternating warp layers and weft layers are stacked to form a helical textile.

4. The textile of claim 1 wherein the weft fibers of different lengths are arranged so that one end of each weft fiber is at the outside diameter of the helical textile.

5. The textile of claim 1, wherein the warp and weft fibers are selected from the group consisting of carbon, graphite, glass, and ceramic.

6. A helical textile made by a process comprising the steps of:

providing a warp knitting machine having at least one conical take-up roll;

adjusting weft insertion to insert weft fibers in a repeating pattern of varying lengths;

warp knitting a helical textile having circumferential warp fibers, a non-interlaced radially aligned weft, and substantially uniform textile thickness, the helical textile defining a radial textile width from a textile inner diameter to a textile outer diameter; and securing the weft fibers to the circumferential warp with chain stitches knitted across the radial textile width.

7. The helical textile of claim 1, wherein the weft fibers comprise individual fibers extending from the textile outer diameter towards the textile inner diameter.

* * * * *